US010337846B2

(12) United States Patent
Tomasoni

(10) Patent No.: US 10,337,846 B2
(45) Date of Patent: Jul. 2, 2019

(54) DEPRIMING DEVICE AND METHOD TO DEPRIME FIREARM CASES

(71) Applicant: Rino Pierino Tomasoni, Ospitaletto (IT)

(72) Inventor: Rino Pierino Tomasoni, Ospitaletto (IT)

( * ) Notice: Subject to any disclaimer, the term of this patent is extended or adjusted under 35 U.S.C. 154(b) by 0 days.

(21) Appl. No.: 15/982,808

(22) Filed: May 17, 2018

(65) Prior Publication Data

US 2018/0335287 A1 Nov. 22, 2018

(30) Foreign Application Priority Data

May 18, 2017 (IT) ..... 102017000054139

(51) Int. Cl.
*F42B 33/04* (2006.01)
*F42B 33/00* (2006.01)

(52) U.S. Cl.
CPC ..... *F42B 33/04* (2013.01); *F42B 33/002* (2013.01)

(58) Field of Classification Search
CPC ..... F42B 33/04; F42B 33/002; F42B 33/00; F42B 33/10
USPC ..... 86/31, 32, 33, 36, 37
See application file for complete search history.

(56) References Cited

U.S. PATENT DOCUMENTS 232,251 A * 9/1880 Farnham ..... F42B 33/04 86/36
242,775 A * 6/1881 Hobbs ..... F42B 33/04 86/36
351,861 A * 11/1886 Greenough ..... F42B 33/004 86/23
366,338 A 7/1887 Migeon
506,425 A * 10/1893 Elliott ..... F42B 33/0292 86/31
514,548 A * 2/1894 Hanson ..... F42B 33/04 86/37
600,613 A * 3/1898 Handshy ..... F42B 33/0292 86/31
716,797 A * 12/1902 Wesson ..... F42B 33/04 86/36
746,368 A 12/1903 Olney
937,604 A * 10/1909 Hodge ..... F42B 33/04 86/36
2,748,648 A * 6/1956 Miller ..... F42B 33/04 86/36
3,097,560 A * 7/1963 Ponsness et al. ..... F42B 33/004 86/27
3,157,086 A * 11/1964 Bachhuber ..... F42B 33/004 86/27
3,313,201 A * 4/1967 Lawrence ..... F42B 33/04 86/32

(Continued)

*Primary Examiner* — Joshua E Freeman
(74) *Attorney, Agent, or Firm* — Volpe and Koenig, P.C.

(57) ABSTRACT

A depriming device and a relative method for the removal of the primer from the head of cases of cartridges for firearms are described. The device includes a depriming mechanism, a device for positioning and restraining at least one case on a surface plate, at the depriming mechanism, and a movement device to shift the depriming mechanism from a raised position, in which the latter is moved away from the case to be deprimed, to a lowered position, in which it comes into contact with the primer of the case and push it thereby causing its detachment from the case itself.

9 Claims, 4 Drawing Sheets

(56) References Cited

U.S. PATENT DOCUMENTS

| | | | | | |
|---|---|---|---|---|---|
| 3,693,497 | A * | 9/1972 | Jacobitz | B21D 1/08 | 86/28 |
| 3,982,465 | A * | 9/1976 | Schabauer | F42B 33/10 | 86/36 |
| 4,027,781 | A * | 6/1977 | Covert | F42B 33/04 | 221/105 |
| 4,078,472 | A * | 3/1978 | Simpson | F42B 33/10 | 86/23 |
| 4,188,855 | A * | 2/1980 | Alberts | F42B 33/04 | 86/23 |
| 4,228,724 | A * | 10/1980 | Leich | F42B 33/004 | 86/23 |
| 4,328,735 | A | 5/1982 | Allen | | |
| 4,549,463 | A * | 10/1985 | Raiha | F42B 33/04 | 86/36 |
| 4,593,598 | A * | 6/1986 | Gunder | F42B 33/10 | 72/352 |
| 4,615,255 | A * | 10/1986 | Carter | F42B 33/004 | 86/23 |
| 4,640,724 | A * | 2/1987 | Carter | F42B 33/0207 | 149/109.6 |
| 5,204,488 | A * | 4/1993 | Cimolino | F42B 5/32 | 86/32 |
| 5,221,806 | A * | 6/1993 | Chaney | F42B 33/04 | 86/19 |
| 6,772,668 | B2 * | 8/2004 | Shields | F42B 33/02 | 86/27 |
| 2004/0025677 | A1 * | 2/2004 | Koch | F42B 33/10 | 86/24 |
| 2015/0198429 | A1 * | 7/2015 | Mirza | F42B 33/04 | 86/37 |

* cited by examiner 1
20
2
A
16
B
C
8
22
6
D
2
5
9

1
21
2
3
20
A
16
X
5
6
18
Y
2
8
22

DEPRIMING DEVICE AND METHOD TO DEPRIME FIREARM CASES

INVENTIVE FIELD

The present invention refers to a depriming device for firearm cartridge cases and, in particular, concerns a device to deprime the cases in series.

BACKGROUND

As is known, firearm cartridges may comprise a bullet, or a plurality of bullets, such as pellets, which are associated to a case that defines a combustion chamber containing gunpowder and a primer that, once actuated, ignites the gunpowder, whose burning triggers the expulsion of the bullet. Generally, the case is closed at one end by means of a base or head; the primer is inserted in the head, in a specific cavity having a hole, named flash hole, which communicates with the combustion chamber. The flame produced by the activation of the primer passes through the flash hole and initiates the combustion of the gunpowder.

Depending on the type and dimensions of the firearm in which they are used, the cartridges, and more specifically the cases, have different calibers, i.e. different diameters.

In the field of sporting or hunting weapons, some users recharge the cartridges used. The cartridge must be deprimed by removing the primer from the head of the case to perform this operation. The case is then recalibrated, equipped with a new primer and recharged with the gunpowder. Then, a new bullet is assembled.

The depriming operation is carried out by means of manual tools, such as pliers, in which the case is positioned, equipped with a pin element mounted on a relative support and pushed inside the flash hole so as to push the primer outside of the cavity of the head. Such depriming devices, also referred to as deprimers, are however manual and require rather long depriming times as each cartridge has to be positioned, deprimed and then removed before proceeding with the next depriming; moreover, such devices must be equipped with pin-holder supports of different dimensions depending on the caliber of the cartridge to be deprimed.

Thus, they are not suitable for depriming quantities of cases in series and in little time.

SUMMARY

An object of the present invention is thus to overcome the drawbacks of the known art by providing an automatic device for the depriming of firearm cases.

Another object of the present invention is to provide a depriming device capable of depriming cases, even of different calibers, in series.

These and other objects are obtained by means of a case depriming device according to claim 1.

Advantageously, the device comprises a surface plate for the positioning of the cases to be deprimed by means of depriming means, preferably with their head resting on the same plate and on which they are restrained, by means of specific means, in a position in which the case going to be deprimed is at the depriming means. The device also comprises means to carry the depriming means in a position that allows them to come into contact with the primer so as to detach it from the case.

Preferably, the depriming means, which comprise a depriming element, named pin, and a supporting shaft, are combined with a main support so as to move together with it by the moving means acting on the support itself.

In a preferred solution, the case is restrained on the surface plate by a couple of fins arranged parallel to one another on the surface plate, at a distance corresponding to the diameter of the cases to be deprimed; in a particularly preferred solution, the distance between the fins varies according to the caliber, and thus to the diameter of the cases to be deprimed.

Advantageously, each fin has a protrusion shaped and dimensioned so as to be inserted in a corresponding groove usually present in the terminal portion of the case. In this way, the case is always restrained in vertical position, thus preventing it from falling or moving away from the surface plate. Furthermore, the shaped fins act as a stopping element whenever a case is incorrectly positioned in the device, i.e. whenever the head is on the opposite side with respect to the surface plate. In fact, the opposite portion of the case, with respect to the head, has not any groove and the diameter would thus be too big to be positioned between the two fins.

Preferably, the cases are brought in the depriming position by the feeding means, which may comprise a carriage sliding on the surface plate between a first and second position, and vice-versa, so as to be moved away from or brought close to the depriming position. The carriage is moved by a relative geared mechanism and any elastic means. In a particularly preferred solution, the geared mechanism is rotated by a cam integral with the main support and thus movable with it. Whenever the main support is in a position away from the working position, the cam is also away from the geared mechanism; during the approach path of the main support towards the case, the cam comes into contact with the geared mechanism and makes it rotate and, consequently, makes the carriage shift in a first direction in which it is shifted from the first position to the second so as to move it away from the depriming position; the carriage is then moved in the opposite direction to bring it back to the first position preferably by elastic means, such as springs. In this way, if a case should be incorrectly positioned on the device, the carriage would be restrained in an intermediate position, allowing the removal of the case without forcing its movement between the fins.

As an alternative, in the reverse transition during which the main support moves away from the case, the cam could make the geared mechanism rotate in an opposite direction, thus making the carriage shift in an opposite direction and bringing it close to the depriming position.

Advantageously, the device may also comprise a secondary support to translate the depriming means with respect to the main support, in an orthogonal direction compared to the movement direction of the main support.

Preferably, the device also comprises means to feed a series of cases on the surface plate, thus avoiding having to load them one at a time. Once inserted in a tubular case feeding element, they are arranged, preferably by gravity one after another on the surface plate, each following the depriming of the previous case, when the support returns in the non-working position and the carriage is moved away from the depriming position.

Furthermore, the invention also concerns a depriming method recited in the claims.

Substantially, the method provides for:

prearranging means, comprising a depriming element to remove the primer from the head of the case; restraining at least one case at the depriming means, by means of appropriate means that can comprise a couple of parallel fins; moving the depriming means close to the head of the case until they come into contact and push the primer of the case to separate it from the head; moving the depriming means away from the case; and possibly repeating the previous steps to deprime a plurality of cases in series.

Advantageously, a step is also provided for positioning at least one case in the depriming position by feeding means comprising a carriage and a geared mechanism for its movement. Preferably, the geared mechanism is rotated by the cam moved and put into contact with the geared mechanism by the movement means during the movements of the depriming means.

Furthermore, the method may provide a step to vary the distance between the fins, at the caliber of the cases to be deprimed.

Preferably, the method provides for prearranging means to insert a plurality of cases to be deprimed in case feeding means, so as to form a row of cases resting one against another so as to ensure that the head of each case is resting against a previous case and acts as a support for the head of the next case, starting from a case in a first position; carrying the carriage in a rearward position to allow the positioning, preferably by gravity, of the case in a second position on the surface plate and near the carriage; and carrying the carriage in an forward position in which it pushes the case in a third position in direction of the depriming position, or in the depriming position.

BRIEF DESCRIPTION OF THE DRAWINGS

Further characteristics and advantages of the invention will be better highlighted by the review of the following specification of a preferred, but not exclusive, embodiment illustrated for illustration purposes only and without limitation, with the aid of the accompanying drawings, wherein.

DETAILED DESCRIPTION OF THE PREFERRED EMBODIMENTS

Figure 1B:
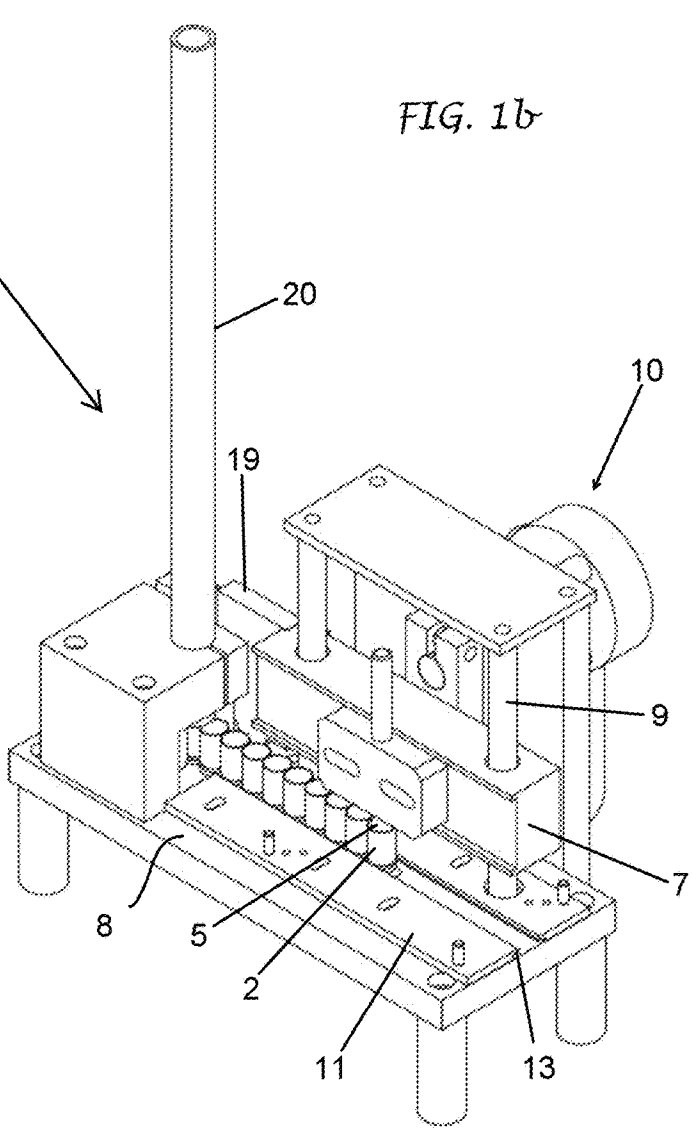
FIGS. 1*a* and 1*b* shows perspective views of a device for depriming firearm cases according to a preferred embodiment, in two different steps of use.
Figure 1A:
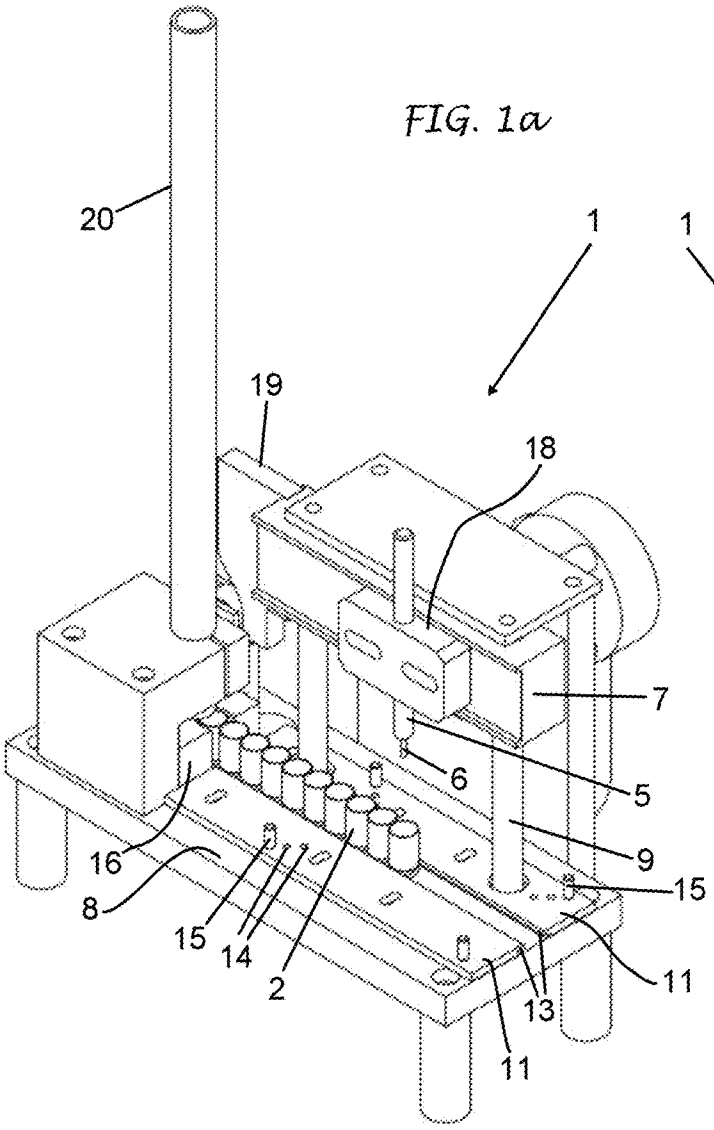

The following detailed description refers to an automatic device 1 for the depriming of firearm cases 2, which is an automatic device to remove the primer 3 from the head 4 of a case.

To this end, the device 1 comprises depriming means that may include a supporting shaft 5 with a pushing element, named pin 6, a main support 7 to which the depriming means 5, 6 are combined and a surface plate 8 on which at least one case to be deprimed is positioned.

The main support 7 and the depriming means therewith are movable so as to be brought close to and away from the surface plate. The support is thus slidingly mounted on sliding guides or shafts 9 and is moved by movement means 10 that can be of automatic or manual type, such as of crank type.

Figure 4B:
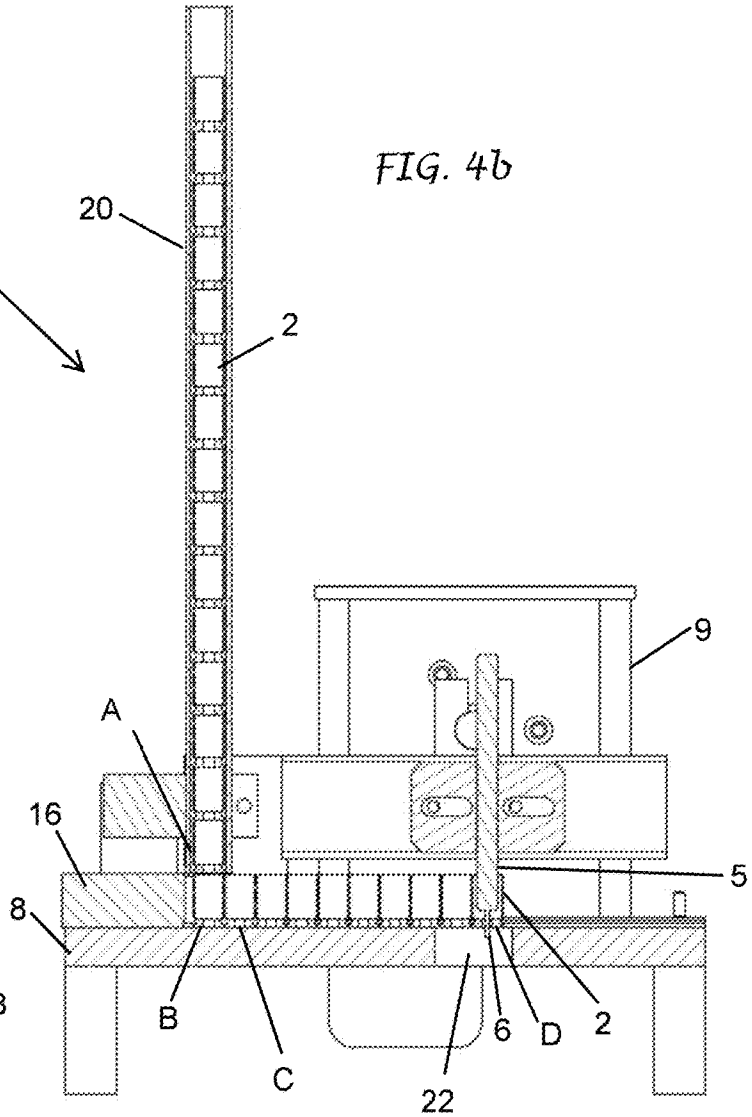
FIGS. 4*a* and 4*b* show sectional front views of FIGS. 1*a* and 1*b* of the device.
Figure 4A:
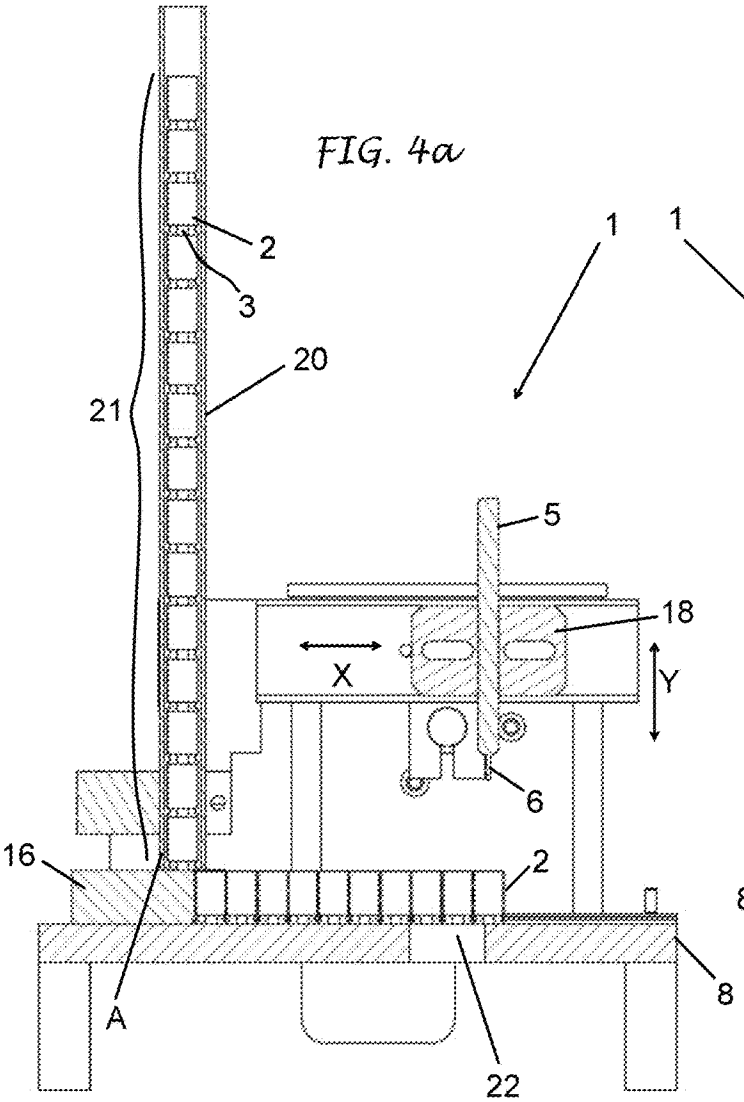
Figure 5B:
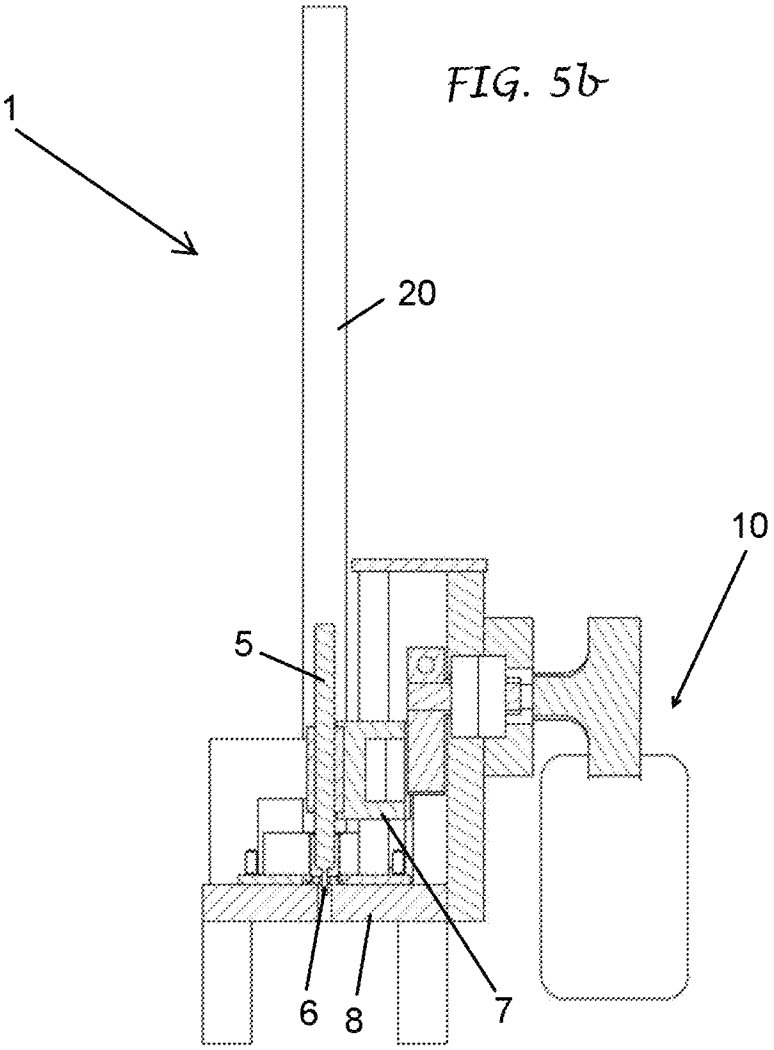
FIGS. 5*a* and 5*b* show sectional side views of FIGS. 1*a* and 1*b* of the device.
Figure 5A:
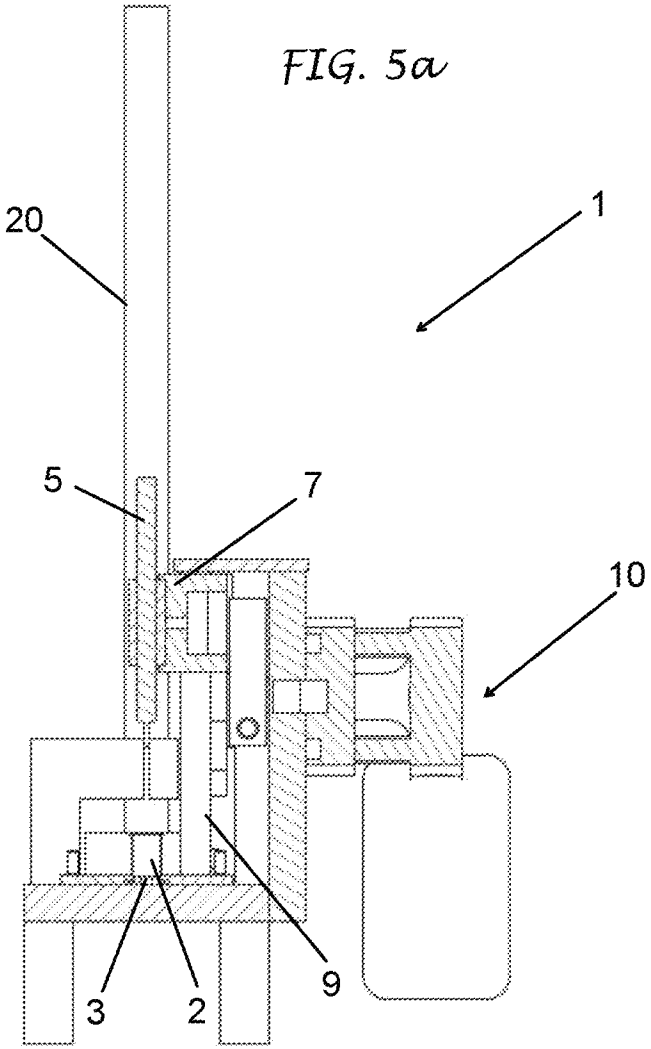

In FIGS. 1*a* and 1*b*, 4*a* and 4*b*, 5*a* and 5*b*, the device is shown in two different phases of the depriming cycle, i.e. with the support and depriming means in a raised position (FIGS. 1*a*, 4*a* and 5*a*) and with the support and depriming means in a lowered position (FIGS. 1*b*, 4*b* and 5*b*).

Means to position and restrain the case to be deprimed from time to time are combined with the surface plate, at the depriming means. Specifically, said means to position and restrain the case comprise a couple of fins 11 fixed to the surface plate so as to be parallel to one another and at a distance corresponding to the diameter of the cases to be deprimed. The cases are thus positioned with their head 4 resting on the surface plate 8 and can slide between the fins. Usually, the type of cases herein considered comprise a groove 12 near the head; consequently, the fins 11 can be shaped so as to each comprise a respective protrusion 13 intended to be inserted in the groove 12 so as to restrain the case in the correct position.

The protrusions 13 of the fins also constitute a stopping element whenever the cases should be positioned incorrectly, i.e. the head should be facing the depriming means rather than the surface plate. In fact, in this case the protrusions of the fins would be leveled with a portion of the case devoid of any groove and thus with a diameter greater than space between the same protrusions and couldn't therefore fit in-between them.

To adapt to the cases of different calibers of different diameters, the fins are fixed to the surface plate so as to slide on it and to be brought closer or further away depending on the need. The positioning of the fins can be carried out manually or automatically by means of mechanical means, such as springs or similar. To facilitate their correct positioning, the fins have a plurality of holes 14 spaced apart from one another to move the fins at predefined distances corresponding to the diameters of the cases of different calibers. Once positioned, the fins can be fixed to the surface plate by means of pivots 15 to be inserted in the hole 14 corresponding to the position selected.

Figure 3:
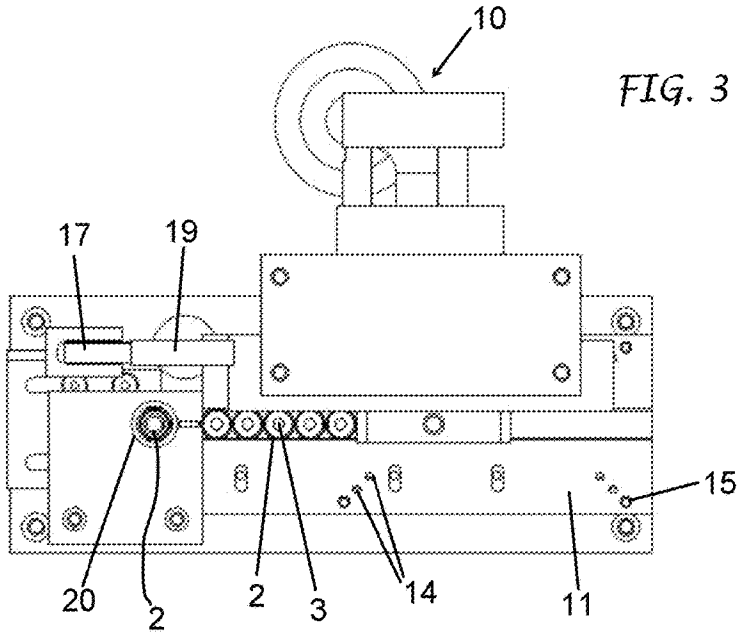
FIG. 3 shows a top view of FIGS. 1*a* and 1*b* of the device.
Figure 6:
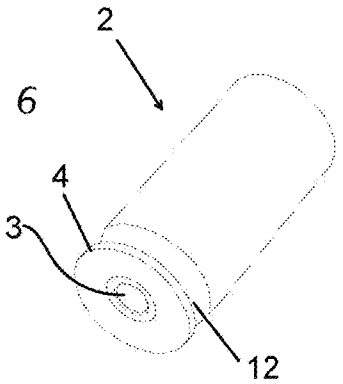
FIG. 6 shows a view of a firearm case.
Figure 2:
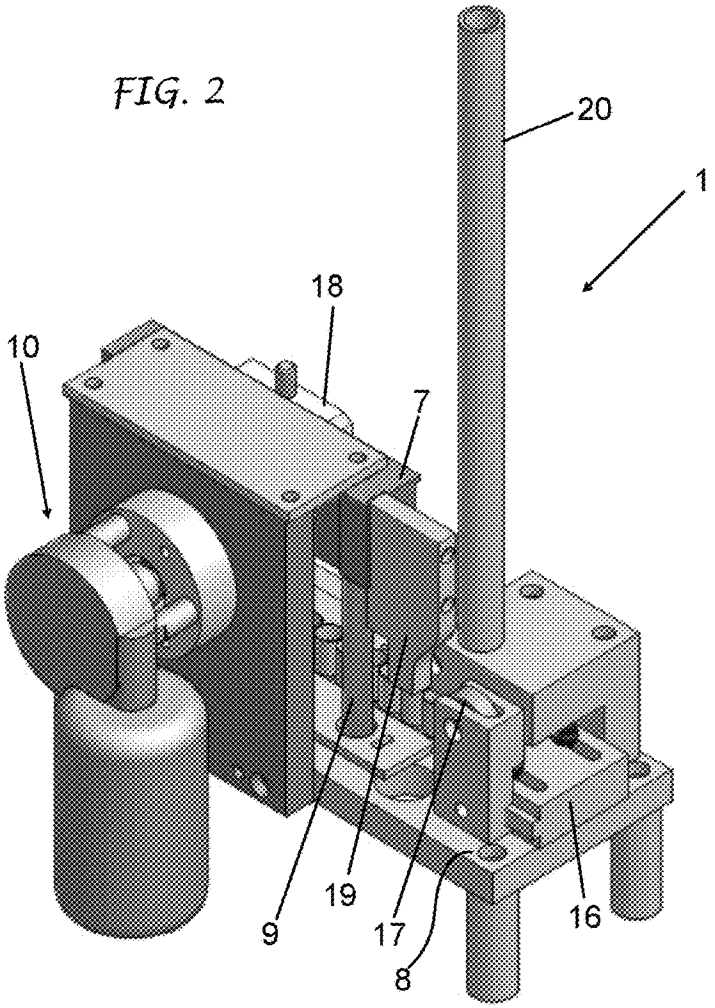
FIG. 2 shows a perspective view from the opposite side of the device of FIGS. 1*a* and 1*b;*

Furthermore, the device comprises feeding means 16, 17 to carry a case at the depriming means 5, 6 from time to time. Whenever the case is positioned correctly, the main support 7 is carried by the movement means from a raised position—as shown in FIG. 3—in which the pin 6 is kept away from the case, to a lowered position shown in FIG. 4 in which, when inside the case 2, the pin comes into contact with the primer 3 and pushes it to detach the same from the head 4 of the case. The case is thus deprimed and ready for the subsequent operations necessary for its regeneration.

In order to vary the position, the depriming means 5, 6 can be mounted on a secondary support 18 movably mounted on the main support in a direction X orthogonal to the X direction of the movement of the main support. Furthermore, the shaft 5 can be combined with the secondary support 18 so as to slide with respect to the latter and to be moved away from or close to the surface plate in a setting step of the device.

Advantageously, the feeding means comprise a carriage 16 sliding, with respect to the surface plate, between a forward resting position (shown in FIG. 4*a*) in which it pushes a case towards a depriming position D, in which the case is at the depriming means 5, 6, and a rearward position (shown in FIG. 4*b*) so as to allow the positioning of a new case to be deprimed. The carriage is then returned to the forward position so as to bring a new case in the depriming position. The carriage is shifted from the forward position to the rearward position by means of a geared mechanism 17 that can rotate to make the carriage move. Once fed with a new case, the carriage can be moved back to the forward position by elastic means—not shown—such as return springs. Alternatively, the carriage can be returned to the forward position by means of the geared mechanism.

Advantageously, the geared mechanism 17 is rotated by a cam 19 integral with the main support 7. When the main support is in a raised position, the cam stays away from the wheel, while during the transition between the raised position and the lowered position, it comes into contact with the wheel, thus causing a rotation. This rotation corresponds to the shift of the carriage 16 from the forward position to the rearward position, in which a new case is fed near the carriage. The cam, during the return path from a lowered position to a raised position, moves away from the wheel and the elastic means carry the carriage back in the forward position, in which it causes the case to move forward and towards the depriming zone, as shown in the figures. Obviously, the movements could also be reversed, i.e. the lowered position of the support could correspond to the forward position of the carriage and the raised position could correspond to the resting position.

The presence of elastic means to return the carriage in the forward position advantageously allows not to cause breakages in the device whenever a case should be incorrectly loaded and stopped by the protrusions of the fins, thus locking the device until this case is removed.

Advantageously, the device also comprises case feeding means 20 that, preferably, comprise a tubular element in which a plurality of cases are inserted, each with the head facing downwards or the surface place, stacked one on top of the other so as to form a row 21 of cases, starting from a case in a first position A. The feeding means are arranged so as to, when the carriage is in rearward position, ensure that the case can move from the first position A to a second position B, in which it is resting on the surface plate near the same carriage. Preferably, the case is moved by gravity to the position B.

Whenever the device is actuated to deprime, the carriage, which is in the forward position in which it obstructs the feeding means 20, is shifted to the rearward position. In this position, the feeding means are no longer obstructed; consequently, the case in the first position A falls by gravity, or is pushed by appropriate means—not shown—on the surface plate in the position B, now devoid of the carriage. Once the depriming operation has been completed, the main support and the cam therewith are returned to the raised position; simultaneously, the elastic means return the carriage to the forward position in which the case, which was in the position B, is moved forward, thus moving it towards a third position C that can be in-between the second position B and the depriming position D or coinciding with the same depriming position.

At this point, the device is ready for a new cycle.

In a preferred solution shown in the figures, the device is structured so as to ensure that more cases are aligned on the surface plate, restrained by the fins and arranged side by side between the carriage and the depriming position D.

In this way, during each work cycle of the device, the case deprimed in the previous cycle is pushed forward by the case that is in the depriming phase and so on, until being unloaded from the surface plate.

Advantageously, a cavity 22 is obtained in the surface plate to receive the primers removed from the cases.

The invention also concerns a method for removing the primer from firearm cases, by using the device specified above.

The method substantially provides for:

1. prearranging a device, as described above, provided with a surface plate and depriming means, 2. feeding the device with at least one case arranged with its head resting on the surface plate;

3. maintaining the at least one case with its head resting on the surface plate;

4. translating the at least one case to move it in a depriming position, in which it is at the depriming means;

5. bringing the depriming means in a lowered position, in which they are partially inside the case with the pin pressed on the primer so as to detach it from the head;

6. bringing the depriming means in a raised position in which they are away from the case;

7. repeating the preceding steps to deprime a plurality of cases.

Advantageously, the case can be moved to the depriming position by means of a carriage 16 moved by means of a gear rotated by a cam integral with the main support of the device and which interacts with the wheel while moving the main support, and by elastic means.

The at least one case can be restrained with its head resting on the surface plate by means of a couple of fins. If the device must deprime cases of different calibers, a step for positioning the fins on the surface plate at a distance corresponding to the caliber of the cases to be deprimed can be provided.

The device can also be provided with feeding means for a plurality of cases. Then, the method will also comprise the step of loading a plurality of cases in the feeding means so that, during each work cycle of the device, a case is brought to the depriming position, is deprimed as a consequence of a translation of the depriming means from the raised position to the lowered position and, subsequently, a new case will be arranged on the surface plate as a consequence of a translation of the depriming means from the lowered position to the raised position.

Advantageously, the device and the relative method thus allow to remove the primer from each case, in series and in an automatic or semi-automatic mode. In fact, thanks to this device, there is no need to position and then remove one case at a time with consequent wastes of time, as more cases can be easily and quickly fed before being automatically brought at the depriming means. The device can then work in automatic or semi-automatic mode simply by turning a crank. In fact, in each depriming cycle, the movement of the main support simultaneously positions the case in the depriming position for the depriming of a case; the next cycle, in addition to the positioning and depriming of a new case, generates the movement of the case previously deprimed towards an unloading position from the surface plate. The different caliber adjustment is also carried out quickly, by simply positioning and fixing the fins at the already existing holes made according to the diameters of the cases, without needing to replace the depriming means according to the calibers.

The invention claimed is:

1. Depriming device (1) to remove a primer (3) from a head (4) of cases (2) of cartridges for firearms, comprising:

depriming means (5, 6), means for positioning and restraining (11) at least one case on a surface plate (8), at the depriming means, and movement means (10) to shift the depriming means (5, 6) from a raised position, in which the latter are moved away from the case (2) to be deprimed, to a lowered position, in which they come into contact with the primer (3) of the case (2) and push it thereby causing its detachment from the case itself, wherein the means for positioning and restraining the case on the surface plate (8) comprise a couple of fins (11)

arranged parallel to one another on the surface plate at a distance corresponding to the diameter of the cases to be deprimed, said fins being able to be provided with means to move them closer/away to/from one another as the diameter of the case to be deprimed changes.

2. The depriming device (1) according to claim 1, comprising a main movable support (7) to which the movement means are combined (10) for shifting it along a direction (Y) between the raised and lowered working positions, and vice versa, and to which the depriming means (5, 6) are constrained to be movable with the support itself and wherein the depriming means comprise a supporting shaft (5) and a pushing element or pin (6) intended to come into contact with the primer (3) and push it, when the pushing element or pin is in the lowered working position.

3. The depriming device (1) according to claim 1, wherein each case is positioned so that its head is rested on the surface plate and wherein the fins (11) are each provided with a respective projection (13) intended to be engaged in a corresponding groove (12) being at the level of the ending portion of the case.

4. The depriming device (1) according to claim 1, further comprising feeding means (16, 17) to position individually a case (2) at the depriming means, wherein said feeding means (16, 17) comprise a carriage (16) sliding with respect to the surface plate between a forward position and a rearward position and vice versa, the carriage being operated by a geared mechanism (17) and by elastic return means.

5. The depriming device (1) according to claim 4, wherein said geared mechanism (17) is rotated by a cam (19) integral with the main support (7) combined with the depriming element, the cam being movable from the position in which it remains away from the geared mechanism and a lowered position in which it engages the geared mechanism (17) thus causing the rotation thereof to shift the carriage from the forward position to the rearward position.

6. The depriming device (1) according to claim 1, further comprising case supplying means (20) for containing a plurality of cases forming a row (21) of cases that extends into the supplying means (20) from a position (A) next to the surface plate (8).

7. Depriming method to remove the primer (3) from the head (4) of cases (2) of cartridges for firearms, comprising the steps of:

a) prearranging depriming means (5, 6) comprising a depriming element (6);

b) restraining at least one case on a surface plate (8) in a depriming position in which it is at said depriming means;

c) prearranging and operating movement means (10) to carry the depriming means (5, 6) to a working position in which they come into contact with the primer (3) of the case (2) to be deprimed;

d) pushing the primer (3) by the depriming means to cause its detachment from the case;

e) moving the depriming means (5, 6) away from the case by the movement means (10);

f) if necessary, repeating the preceding steps in order to deprime a plurality of cases in series;

wherein the step b) is carried out by a couple of parallel fins combined with the surface plate and spaced from one another of a distance corresponding to the diameter of the case to be deprimed, and wherein the step of changing the distance between the fins can be provided depending on the caliber of the cases to be deprimed.

8. The depriming method according to claim 7, wherein it is provided the step of carrying at least one case to the depriming position to be deprimed, by feeding means (16, 17) comprising a carriage (16) and a geared mechanism (17), said step being carried out by shifting the carriage between a forward position in which it is close to the depriming position, and a rearward position in which it is supplied with a case to be deprimed, by the geared mechanism rotated by a cam (19) integral with the main support and moved by the movement means (10) during the step d) of moving the depriming means; and by returning the carriage to the forward position by elastic means to carry a case next to the depriming means.

9. The depriming method according to claim 7, wherein the steps are provided, of:

g) prearranging case supplying means (20) to supply cases;

h) inserting, in the supplying means, a plurality of cases to be deprimed, to form a row of cases to be supplied to the surface plate, each case of said row of cases being rested with its head on a preceding case and serving as a support for the head of a subsequent case, starting from a case in a first position (A) of the supplying means, i) carrying the carriage to the rearward position to allow said case in the first position (A) to be positioned in a second position (B), in which it is on the surface plate next to the carriage; and l) returning the carriage to the forward position to carry said case to a third intermediate position (C) in the direction of the depriming position, or in the depriming position (D) itself.

* * * * *